United States Patent [19]

Roggenkamp

[11] 3,943,234

[45] Mar. 9, 1976

[54] ACIDIC EMOLLIENT LIQUID DETERGENT COMPOSITION

[75] Inventor: Charles L. Roggenkamp, Cincinnati, Ohio

[73] Assignee: The Procter & Gamble Company, Cincinnati, Ohio

[22] Filed: Aug. 9, 1973

[21] Appl. No.: 386,929

[52] U.S. Cl. ..... 424/343; 252/142; 252/143; 252/144; 252/153; 252/154; 252/173; 252/547; 252/DIG. 5; 252/DIG. 13; 252/DIG. 14; 424/325

[51] Int. Cl.[2]... C11D 1/75; C11D 3/20; C11D 3/46; C11D 17/08

[58] Field of Search ..... 252/117, 118, 142, 143, 252/144, 153, 173, 528, 547, DIG. 5, DIG. 13, DIG. 14, 154; 424/325, 343, 358

[56] References Cited

UNITED STATES PATENTS

| | | | |
|---|---|---|---|
| 3,442,812 | 5/1969 | Barnhurst | 252/142 |
| 3,449,430 | 6/1969 | Dohr | 252/547 X |
| 3,470,102 | 9/1969 | Heinz | 252/528 X |
| 3,496,110 | 2/1970 | Shumway | 252/142 |
| 3,557,006 | 1/1971 | Ferrara | 252/117 |
| 3,658,985 | 4/1972 | Olson | 424/70 |
| 3,679,611 | 7/1972 | Gerecht | 252/542 |
| 3,711,414 | 1/1973 | Hewitt | 252/118 |
| 3,793,233 | 2/1974 | Rose | 252/547 |
| 3,808,311 | 4/1974 | Olson | 424/70 |
| 3,809,659 | 5/1974 | Gerecht | 252/542 |

*Primary Examiner*—Dennis E. Talbert, Jr.
*Assistant Examiner*—Dennis L. Albrecht
*Attorney, Agent, or Firm*—Jerry J. Yetter; Richard C. Witte; Thomas H. O Flaherty

[57] ABSTRACT

Liquid compositions containing an amine oxide, an occlusive emollient, and a pH controlling agent exhibit enhanced adsorption of the emollient material on keratinous substrates such as skin when employed as a detergent composition at an acid pH.

7 Claims, No Drawings

ACIDIC EMOLLIENT LIQUID DETERGENT COMPOSITION

BACKGROUND OF THE INVENTION

This invention relates to compositions specifically designed to promote the deposition of emollient materials on skin while concurrently performing a cleaning function. More particularly, the invention encompasses liquid detergent compositions especially adapted for dishwashing and other cleaning uses under conditions which involve the immersion of skin in water containing said detergent compositions. The detergent compositions herein enhance the deposition of the emollient on the skin and provide an occlusive film thereon.

The use of emollients in light duty liquid detergents and shampoo compositions is well known. The desirability of compositions which provide an emollient benefit to skin concurrently with a detergent effect has long been recognized, but has been difficult to achieve. The mechanisms of emollient deposition and soil removal are generally in conflict. Emollient materials are usually oily in nature and provide a "load" which substantially detracts from the cleaning and sudsing of detergent compounds. Conversely, the cleaning action of the detergent component of such compositions usually removes oily or waxy emollients from the skin, thereby frustrating the purpose for including such materials in detergent compositions.

By the present invention there are provided liquid detergent compositions comprising an emollient material, an amine oxide and a pH controlling agent. It has been discovered that the use of an amine oxide at an acid pH results in an increase of the lipophilic character of keratinous surfaces such as skin or hair. The increased lipophilic character of the keratinous surface enhances the adsorption of waxy or oily emollients thereon. Accordingly, enhanced deposition of waxy and oily emollients onto surfaces such as skin is achieved by the compositions herein.

Previous efforts have been directed to the formulation of detergent compositions and shampoos containing emollient materials. For example, U.S. Pat. Nos. 2,519,062; 1,674,580 and British Pat. No. 1,054,244 disclose compositions comprising an anionic surfactant and oily or waxy emollient materials. However, the compositions disclosed in these patents are not specifically designed to promote the adsorption of the emollients onto skin in the manner of the present invention.

The use of amine oxides in emollient-containing detergent compositions is suggested in U.S. Pat. No. 3,533,955 and in THE CHEMICAL FORMULARY, Vol. XVI, page 88. An aerosol shaving cream comprising a stearic acid soap, an amine oxide and a silicone fluid is described in THE CHEMICAL FORMULARY, Vol. XVI, page 120. U.S. Pat. No. 3,098,794 relates to hair grooming compositions comprising fatty alcohols and amine oxides. British Pat. No. 1,254,309 discloses shampoos comprising amine oxide conditioning agents. However, none of the foregoing references discloses the use of amine oxides in combination with waterinsoluble emollients and a pH controlling agent capable of maintaining the pH of an aqueous washing medium within the acid range.

Amine oxides are well known for use in detergent compositions; see U.S. Pat. Nos. 3,001,945; 3,223,647; 3,281,368; 3,441,508, 3,441,611; 3,441,612; 3,450,637; and 3,313,734. While these patents suggest the use of amine oxides in conjunction with many of the usual detergent adjuvants, such use is consistently at pH's within the basic range, rather than at the acidic ranges employed in the instant invention. Accordingly, the prior art does not appear to have recognized that amine oxides can be employed under acidic conditions to lipophilize the skin, thereby promoting the adsorption of emollient materials thereto.

It is an object of the present invention to provide liquid detergent compositions which achieve an emollient effect on keratinous surfaces such as skin and hair when employed in an aqueous washing solution.

It is a further object herein to provide emollient detergent compositions specifically adapted to hand dishwashing and hand laundering.

These and other objects are obtained herein as will be seen from the following disclosure.

SUMMARY OF THE INVENTION

The present invention encompasses liquid detergent compositions which provide emolliency benefits when used in contact with skin, hair or other keratinous surfaces, comprising:

i. from about 0.5 to about 50% by weight of an amine oxide of the formula RR'R''NO, wherein R is an alkyl group containing from about 8 to about 30 carbon atoms, and wherein R' and R'' are each alkyl groups containing from about 1 to about 18 carbon atoms;

ii. from about 0.5 to about 20% by weight of a water-insoluble emollient;

iii. from about 0.1 to about 20% by weight of a pH controlling agent;

iv. the balance of said composition comprising a liquid carrier, the pH of a 0.2% by weight aqueous solution of said composition being in the acidic range.

The detergent compositions herein are preferably employed in an aqueous solution at a concentration of about 0.2% by weight. Of course, the amount employed will depend on the desires of the user and the soil load encountered.

The compositions herein can be used to cleanse fabrics, hard surfaces such as dishes, floors and walls, or for personal care. The compositions are especially adapted for use in hand laundering and hand dishwashing operations and provide desirable skin softening and emolliency benefits concurrently with cleaning.

DETAILED DESCRIPTION OF THE INVENTION

The liquid detergent compositions herein comprise three essential components, as well as a carrier liquid. The compositions can optionally contain auxiliary materials designed to augment their cleaning and aesthetic attributes. These various components are described in detail, below.

The Amine Oxide Component

The amine oxides employed in the present invention are of the general formula RR'R''NO, wherein R is an alkyl group containing from about 8 to about 30, preferably about 8 to about 18, carbon atoms. Groups R' and R'' are each alkyl groups containing from about 1 to about 18, preferably from about 1 to about 4, carbon atoms.

Amine oxides of the type useful herein can be prepared by the oxidation of tertiary amines in the manner set forth in U.S. Pat. No. 3,223,647 and British Pat. No.

437,566. In general terms, amine oxides are prepared by the controlled oxidation of the corresponding tertiary amines.

Non-limiting examples of tertiary amine oxides useful in the compositions herein are dodecyldimethyl amine oxide, tridecyldimethyl amine oxide, tetradecyldimethyl amine oxide, pentadecyldimethyl amine oxide, hexadecyldimethyl amine oxide, heptadecyldimethyl amine oxide, octadecyldimethyl amine oxide, dodecyldiethyl amine oxide, tetradecyldiethyl amine oxide, hexadecyldiethyl amine oxide, octadecyldiethyl amine oxide, dodecyldipropyl amine oxide, tetradecyldipropyl amine oxide, hexadecyldipropyl amine oxide, octadecyldipropyl amine oxide, dodecyldibutyl amine oxide, tetradecyldibutyl amine oxide, hexadecyldibutyl amine oxide, octadecyldibutyl amine oxide, dodecylmethylethyl amine oxide, tetradecylethylpropyl amine oxide, hexadecylpropylbutyl amine oxide, and octadecylmethylbutyl amine oxide.

Also useful herein are the amine oxides which are prepared by the oxidation of tertiary amines prepared from mixed alcohols obtainable from coconut oil. Such mixed coconutalkyl amine oxides are preferred from an economic standpoint inasmuch as it is unnecessary, for the present purposes, to separate the mixed alcohol fractions into their pure components to secure the pure chain length fractions of the amine oxides.

The preferred amine oxides herein are those wherein groups R′ and R″ are each methyl. Especially preferred amine oxides herein are dodecyldimethyl amine oxide, tetradecyldimethyl amine oxide, hexadecyldimethyl amine oxide, octadecyldimethyl amine oxide and the mixed coconutalkyldimethyl amine oxides.

The Emollient Component

The emollient materials employed in the present compositions are those water-insoluble, oily and waxy materials well known for their cosmetic benefits on skin. Preferred emollient materials herein include the waterinsoluble waxy or oily fatty alcohols, fatty glycols and diols, fatty polyols and fatty acid esters.

Non-limiting examples of water-insoluble emollient materials useful herein include the primary and secondary $C_{12}$–$C_{22}$ monohydric alcohols, the $C_{12}$–$C_{22}$ diols and the $C_{12}$–$C_{22}$ polyols. As specific examples of such materials there can be mentioned 1-dodecanol, 1-tetradecanol, 1-octadecanol, 1-eicosanol, 2-dodecanol, 3-octadecanol, 4-docosanol, 1,4-tetradecanediol, 1,2-octadecanediol, 1,2-docosanediol, 1,2,3-hexadecanetriol, 1,2,4-eicosanetriol, 1,1,2,2docosanetetra-ol, and the like.

Specific, non-limiting examples of water-insoluble ester emollients useful in the compositions herein include the triglyceride esters of the fatty acids, including materials such as olive oil, peanut oil, almond oil, sunflower oil, cottonseed oil, soybean oil, and coconut oil. Natural or synthetic fatty acid esters, such as isopropyl myristate, isopropyl palmitate, isopropyl stearate, butyl stearate, and the like are all useful herein as the water-insoluble emollient. Other ester materials include the complex fatty cholesterol derivatives and the lanolin alcohol esters. The various fluid silicones can also be employed as the emollient component of the instant invention.

Branched-chain oily and waxy emollients, especially materials such as 2-octyldodecanol, are well known as bath oil additives and are suitable for use as the emollient component of the instant compositions.

Cetyl alcohol (hexadecanol) is an especially preferred emollient material for use in the present compositions.

The pH Controlling Agent

The amine oxide component of the instant compositions performs its lipophilizing effect on skin when employed under acidic conditions. Accordingly, the compositions herein are formulated to provide an acidic pH in aqueous cleaning solutions. Since neither the amine oxide nor the emollient component of the compositions appreciably contributes to the acidulation of the cleaning solution, a pH controlling agent is employed in the compositions.

While the compositions herein are useful at any pH below neutrality, it is preferred that they be employed in a cleaning solution at a pH of from 4.0 to 6.9.

Inorganic acids, such as hydrochloric acid, sulfuric acid and the like can be employed in the instant compositions to maintain the pH of the aqueous cleaning solution within the desired pH range. However, the use of non-buffering acids is inconvenient, inasmuch as the pH of the compositions, themselves, are quite low when non-buffering inorganic acids are employed as the pH controlling agent. Accordingly, it is preferable to employ as the pH controlling agent an organic acid having a $pK_a$ of 6, or below, or one of the common buffer materials which establishes and maintains the pH of the cleaning solution within the desired acid range.

Specific, non-limiting examples of buffer materials useful herein include the buffer solutions of Clark and Lubs set forth in Hawk's "Physiological Chemistry" 14th Ed., Oser, pages 41–43. Such acidic buffer materials include potassium phthalate buffers, phosphate buffers and acetate buffers.

Additional examples of useful pH controlling agents herein include citric acid, acetic acid, maleic acid, and mixtures thereof, and acid buffers comprising mixtures of these acids and their water-soluble alkali metal salts.

The type of acidic pH controlling agent employed herein is not critical to the invention, inasmuch as all that is required is that the pH of the washing solution be maintained within the acidic range. Citric acid, acetic acid and maleic acid are preferred pH controlling agents herein from the standpoint of availability and compatibility. Acetic acid and acetic acid/sodium acetate buffers are especially preferred for this use, and are readily available.

Carrier

The compositions herein are conveniently employed in a liquid form. Accordingly, the foregoing components are admixed with a liquid carrier material. The choice of liquid carriers is immaterial, except that they should be safe, compatible with the foregoing active components, and should not interfere with the lipophilizing action of the acidulated amine oxide material or with the deposition of the emollient on the lipophilized skin surface. The carrier liquids should not be in a basic form to avoid neutralization of the acidic pH controlling agent.

The most useful and preferred carrier liquids herein include water and water-alcohol mixtures. Water-alcohol mixtures are preferred inasmuch as the alcohol component aids in the dispersion and dissolution of the emollient and the amine oxide. Moreover, the alcohol can be used to adjust the viscosity of the compositions to a desired level.

Useful alcohols herein include ethanol, propanol and butanol. Ethanol is preferred from an overall aesthetic standpoint. Preferred carrier liquids herein include water and water-ethanol mixtures containing from about 1 to about 50% ethanol.

Auxiliary Materials

The compositions herein can optionally contain auxiliary materials which augment their cleaning and aesthetic qualities.

It is preferred to include from about 0.5 to about 75% by weight of a non-interfering auxiliary surfactant in addition to the amine oxide in the compositions herein. The use of an additional surfactant ingredient enhances the cleaning activity and contributes to the maintenance of desirable sudsing in the products. When preparing compositions for general light-duty use, such as for dishwashing or hand laundering, the auxiliary surfactant is usually added in an amount of from about 5 to about 50% by weight of the total composition. Heavy-duty fabric laundering compositions will generally contain up to about 75% by weight of the auxiliary surfactant.

A wide variety of organic, water-soluble detersive surfactants can optionally be employed in the compositions herein. The choice of the type of surfactant depends on the desires of the user with regard to the intended purpose of the compositions and the commercial availability of the surfactant. The only limitation on the surfactants which can be added to the compositions herein is that they not interfere with the lipophilizing action of the acidulated amine oxide. For example, the alkyl glycerol ether sulfonates have been found to make the skin more lipophobic and to decrease the deposition of emollients when used in combination with acidulated amine oxides in the manner of the present invention. Accordingly, alkyl glycerol ether sulfonates are not contemplated for use as an auxiliary surfactant in the instant compositions.

The compositions herein can contain any of the anionic, cationic, nonionic and amphoteric surfactants commonly employed in detergent compositions, exclusive of those surfactant materials which tend to make the skin surface lipophobic. Surfactants which make the skin surface more lipophobic can be determined by simply comparing the total amount of emollient deposited on the skin in the presence and absence of added surfactant.

Specific, non-limiting examples of compatible detersive surfactants useful in the present compositions are set forth below. The term "alkyl" used to describe these various surfactants encompasses the hydrocarbyl alkyl groups having a chain length of from $C_{10}$ to $C_{22}$, i.e., materials of the type generally recognized for use as detergents. Suitable surfactants which can be employed in the compositions herein include anionic surfactants such as the alkyl sulfates, alkylbenzene sulfonates, olefin sulfonates, fatty acyl isethionates and taurides, alkyl sulfoccinates, alkyl ether sulfates ($AE_xSO_4$) and many others. Common fatty acid soaps are also useful herein.

Suitable nonionic surfactants include the polyethoxysorbitan esters, fatty acyl mono- and di-ethanol amides, $C_8$- $C_{22}$ ethoxylates and mixed coconut ethoxylates containing 1 to 30 ethoxylate groups. The ethoxylates can be conveniently employed at concentrations of from 0.5 to 10% by weight to provide appropriate suds levels.

Suitable zwitterionic surfactants include the fatty alkyl betaines and sulfobetaines and similar compounds such as $C_8$ to $C_{18}$ ammonio propane sulfonate and $C_8$ to $C_{18}$ hydroxy ammonio propane sulfonates. The ammonio propane sulfonates can be employed at concentrations of from 1 to 5% by weight of the composition to provide appropriate suds levels.

The anionic surfactants can be in the form of their water-soluble salts, for instance the amine, ammonium, alkanolammonium or alkali metal salts. For most purposes it is preferred to use the anionic materials in their sodium or ammonium salt form. Generally, it is preferred to use anionic surfactants in the compositions herein because of their high foaming character. Especially preferred anionic surfactants herein include the alkyl ether sulfates of the general formula $AE_xSO_4$ wherein $A=C_{10}$-$C'_{22}$ alkyl, E is ethylene oxide, and wherein x is an integer from 0 to 30; the $C_{10}$–$C_{14}$ olefin sulfonates, and mixtures thereof.

The compositions herein may optionally contain other oily materials which are not properly classified as emollients, such as perfume oils and water miscible substances having antiseptic, bactericidal or bacteriostatic properties, or therapeutic properties, and, in general, the affinity of these oily materials for the skin is also promoted by the acidulated amine oxides.

Other optional additives such as perfumes, thickeners such as carboxymethyl cellulose, enzymes, colorants, and the like can be employed in the compositions to enhance their aesthetic and/or performance characteristics. The only requirement of such additional materials is that they be non-basic and compatible with the active components.

Detergency builder materials can be employed in the instant compositions to sequester calcium and magnesium hardness ions, thereby promoting the detergency action. Such builder materials can be employed at concentrations of from about 5 to about 30% by weight of the total compositions. Of course, the amount can be varied depending on the water hardness encountered.

The common alkaline detergency builder materials are not useful herein since they interfere with the acidulation of the cleaning solutions. Conversely, any of the well known neutral and acidic sequestrants can be employed in the present compositions to provide a builder function.

Examples of non-interfering builder materials useful in the present compositions include the water-soluble polycarboxylic acids, polysulfonic acids, polymaleic acids, aminopolyacetic acids, and the like.

Specific examples of non-interfering builder materials useful in the present compositions include ethylenediaminetetraacetic acid, nitrilotriacetic acid, mellitic acid, oxydisuccinic acid, and the co-polymers of aliphatic carboxylic acids such as maleic acid, itaconic acid, mesaconic acid, fumaric acid, aconitic acid, citraconic acid, and methylenemalonic acid. These latter polymers are described in U.S. Pat. No. 3,308,067, incorporated herein by reference. Additional useful builder materials herein include carboxymethyloxymalonic acid, carboxymethoxysuccinic acid, cis-cyclohexanehexacarboxylic acid, cis-cyclopentanetetracarboxylic acid and phloroglucinol trisulfonic acid. The acidic or neutral salts, especially the triethanolammonium salts of the foregoing acids, are also useful in the present compositions.

The foregoing acidic materials can also be employed, in their acid form, as the pH controlling agents herein.

Citric acid, a preferred pH controlling component of the instant inventions, also provides a sequestrant-/builder effect.

The compositions herein are prepared by simple blending of the various components.

Preferred compositions herein containing optional added surfactants, builders, and other auxiliary materials typically comprise from about 1 to about 10% by weight of the amine oxide, from about 1 to about 5% by weight of the emollient, from about 1 to about 5% by weight of the pH controlling agent, from about 0% to about 40% by weight of the non-interfering auxiliary surfactant, from about 0% to about 25% by weight of the optional, non-interfering builder, from about 0% to about 3% of the other optional additives, the balance of the compositions being the liquid carrier.

The following examples illustrate the compositions of the present invention, but are not intended to be limiting thereof.

A liquid detergent composition especially adapted for hand dishwashing is as follows.

EXAMPLE I

| Ingredient | % (wt.) |
|---|---|
| Cetyl alcohol | 3.0 |
| Coconutalkyldimethyl amine oxide | 3.5 |
| Alkyl ether sulfate[1] | 25.0 |
| Alkyl sulfate[2] | 15.0 |
| Acetic acid | 3.2 |
| Sodium acetate | 8.0 |
| Ethanol | 8.0 |
| Miscellaneous[3] | 4.0 |
| Water | Balance |

[1]Coconutalkyl(ethoxylate)$_{12}$ sulfate, ammonium salt.
[2]Mixed coconutalkyl sulfates, ammonium salt.
[3]Including KCl electrolyte, perfume, colorant.

The foregoing composition is employed as a 0.2% by weight aqueous solution in a sink. The pH of the solution is ca. 6. The aqueous solution of the composition exhibits satisfactory cleaning of dishes and glassware in a hand dishwashing operation. Immersion of the user's hands in the aqueous solution results in a smooth, emollient effect thereon.

In the foregoing composition the cetyl alcohol is replaced by an equivalent amount of 1-dodecanol, 1-tetradecanol, 3-octadecanol, 2-octyldodecanol, and isopropylmyristate, respectively, and equivalent cleaning and emolliency benefits are secured.

The following composition is adapted for hand dishwashing and light-duty hand laundering.

EXAMPLE II

| Ingredient | % (wt.) |
|---|---|
| Coconutalkyldimethyl amine oxide | 5.0 |
| Cetyl alcohol | 5.0 |
| Citric acid | 10.0 |
| Ethanol | 10.0 |
| Perfume | 0.2 |
| Dye | 0.3 |
| Miscellaneous minors | 1.0 |
| Water | Balance |

The above composition is prepared by admixing the amine oxide with the water and stirring until the amine oxide is dissolved. The citric acid is dissolved in the water. The cetyl alcohol is stirred with the ethanol and blended in the foregoing solution, which remains substantially clear. The minor components are then added and a stable, clear composition is secured.

The composition is added to an aqueous laundering bath at a level of about 0.3% by weight. The pH of the solution is ca. 5.5. The aqueous solution of the composition exhibits satisfactory cleaning of cotton andd polyester fabrics in a hand laundering operation. Immersion of the user's hands in the aqueous solution results in a smooth, emollient effect thereon.

In the foregoing composition the cetyl alcohol is replaced by an equivalent amount of olive oil, coconut oil, and dimethyl silicone fluid, respectively, and equivalent emolliency benefits are secured.

In the foregoing composition the coconutalkyldimethyl amine oxide is replaced by an equivalent amount of dodecyldimethyl amine oxide, tetradecyldimethyl amine oxide, hexadecyldimethyl amine oxide, and octadecyldimethyl amine oxide, respectively, the equivalent results are secured.

In the foregoing composition the citric acid is replaced by an equivalent amount of acetic acid and maleic acid, respectively, the equivalent results are secured.

EXAMPLE III

| Ingredient | % (wt.) |
|---|---|
| Coconutalkyldimethyl amine oxide | 4.5 |
| Cetyl alcohol | 3.0 |
| Citric acid | 5.0 |
| Oxydisuccinic acid | 7.0 |
| Olefin sulfonate[1] | 8.0 |
| Alkyl ether sulfate[2] | 25.0 |
| Ethanol | 10.0 |
| Miscellaneous minors | 1.0 |
| Water | Balance |

[1]$C_{12}$–$C_{14}$ olefin sulfonate mixture, sodium salt.
[2]Coconutalkyl (ethoxylate)$_{12}$ sulfate, sodium salt.

The foregoing composition is adapted for use as a heavy-duty cleaning composition under hard water conditions. The composition is employed at a concentration of about 0.25% by weight in an aqueous solution. The pH of the solution is ca. 6. The aqueous solution of the composition exhibits satisfactory cleaning of dishes, floors, walls and the like. The composition is also useful for hand laundering nylon, polyester, cotton and blended fabrics. Immersion of the user's hands in the aqueous solution of the composition results in a smooth, emollient effect thereon.

In the above composition the oxydisuccinic acid is replaced by an equivalent amount of mellitic acid, ethylenediaminetetraacetic acid, nitrilotriacetic acid, carboxymethoxysuccinic acid and phloroglucinol trisulfonic acid, respectively, and equivalent results are secured.

In the above composition the ethyl alcohol is replaced by an equivalent amount of propyl alcohol, and equivalent results are secured.

In the above composition the cetyl alcohol is replaced by an equivalent amount of 1,4-tetradecanediol, 1,2-octadecanediol, 1,2,3-hexadecanetriol and 1,1,2,2-do-cosanetetra-ol, and equivalent results are secured.

The invention herein has been fully set forth in its compositional aspects. The invention also encompasses, in a method aspect, a process for adsorbing emollient materials of the type herein disclosed on skin, comprising contacting said skin with an aqueous mixture comprising from about 0.001% to about 1% by weight of an amine oxide of the type disclosed above, and from about 0.001% to about 1% by weight of an emollient, at a pH of from about 4 to about 6.9, preferably, pH 4 to 6.

What is claimed is:

1. A liquid dishwashing detergent composition which provides skin emolliency benefits consisting essentially of i. from about 1% to about 10% by weight of an amine oxide of formula $RR'R''N \rightarrow O$ wherein R is an alkyl group containing from about 8 to about 18 carbon atoms and wherein R′ and R″ are each $C_1$–$C_4$ alkyl groups;

ii. from about 1% to about 5% by weight of a $C_{12}$–$C_{22}$ monohydric alcohol serving as an emollient;

iii. from about 1 to about 5% by weight of an organic acidic pH controlling agent;

iv. from about 5% to about 50% by weight of a noninterfering auxiliary surfactant selected from the group consisting of water-soluble $C_{10}$–$C_{14}$ olefin sulfonates, $C_{10}$–$C_{22}$ alkyl sulfates and alkyl ether sulfates containing up to 30 ethylene oxide groups and mixtures thereof;

v. the balance of said composition comprising a liquid carrier selected from the group consisting of water and mixtures thereof with $C_2$–$C_4$ alcohols; the pH of a 0.2% by weight aqueous solution of said composition lying within the range 4–6.9.

2. A composition according to claim 1 wherein the amine oxide is a member selected from the group consisting of dodecyldimethyl amine oxide, tetradecyldimethyl amine oxide, hexadecyldimethyl amine oxide, octadecyldimethyl amine oxide, and mixed coconutalkyldimethyl amine oxides.

3. A composition according to claim 1 wherein the emollient is cetyl alcohol.

4. A composition according to claim 1 wherein the pH controlling agent has a $pK_a$ of 6, or below.

5. A composition according to claim 1 wherein the pH controlling agent is a member selected from the group consisting of citric acid, acetic acid, maleic acid, and acidic mixtures of these acids and their water-soluble salts.

6. A composition according to claim 1 which additionally contains from about 5% to about 30% by weight of a non-interfering detergency builder selected from the group consisting of acidic and neutral water-soluble salts of citric acid, ethylene diamine tetraacetic acid, nitrilotriacetic acid, mellitic acid, oxydisuccinic acid, carboxymethoxysuccinic acid, carboxymethyloxy malonic acid, cis-cyclohexane hexacarboxylic acid, cis-cyclopentane tetracarboxylic acid and phloroglucinol trisulfonic acid.

7. A process for adsorbing emollient materials on skin comprising contacting said skin with an aqueous mixture comprising from about .001% to about 1% by weight of an amine oxide of the formula $RR'R''N \rightarrow O$ wherein R is an alkyl group containing from about 8 to about 18 carbon atoms and wherein R′ and R″ are each $C_1$–$C_4$ alkyl groups, from about .005% to about 5% by weight of a non-interfering auxiliary surfactant selected from the group consisting of water-soluble $C_{10}$–$C_{14}$ olefin sulfonates, $C_{10}$–$C_{22}$ alkyl sulfates and alkyl ether sulfates containing up to 30 ethylene oxide groups and mixtures thereof, and from about 0.001% to about 1% by weight of a $C_{16}$ monohydric alcohol serving as an emollient, at a pH of from about 4 to about 6.9.

* * * * *